United States Patent [19]

Kurihara et al.

[11] Patent Number: 4,480,935

[45] Date of Patent: Nov. 6, 1984

[54] PRINTING TYPE DRUM

[75] Inventors: Hitoshi Kurihara; Toru Wakazawa, both of Chichibu, Japan

[73] Assignee: Canon Denshi Kabushiki Kaisha, Tokyo, Japan

[21] Appl. No.: 501,748

[22] Filed: Jun. 9, 1983

Related U.S. Application Data

[63] Continuation of Ser. No. 284,112, Jul. 16, 1981, abandoned.

[30] Foreign Application Priority Data

Jul. 23, 1980 [JP] Japan ..... 55-99761

[51] Int. Cl.[3] ..... B41J 1/22

[52] U.S. Cl. ..... 400/145.2; 400/146; 400/142; 400/152

[58] Field of Search ..... 400/142, 145, 145.1, 400/145.2

[56] References Cited

U.S. PATENT DOCUMENTS

| | | | |
|---|---|---|---|
| 3,207,067 | 9/1965 | Schaller | 400/152 X |
| 3,640,369 | 2/1972 | Rolph | 400/145.2 |
| 4,015,699 | 4/1977 | Kondur, Jr. | 400/145 |

*Primary Examiner*—Edgar S. Burr
*Assistant Examiner*—David A. Wiecking
*Attorney, Agent, or Firm*—Fitzpatrick, Cella, Harper & Scinto

[57] ABSTRACT

There is disclosed an integrated cylindrical formation of plural lines of a printing type belt in such a printing type drum as contains a hammer unit therein, has plural lines of printing type belts installed round the periphery of the cylindrically formed drum body and supplied printing ink to the types by pressing an ink roller against the printing type belts.

2 Claims, 9 Drawing Figures

PRINTING TYPE DRUM

This application is a continuation of application Ser. No. 284,112 filed July 16, 1981, now abandoned.

BACKGROUND OF THE INVENTION

1. Field of the Invention

The present invention relates to a printing type drum and, more particularly, to a printing type drum for use in such a small printer which prints by striking its printing type belts with hammers from inside of the printing type drum.

2. Description of the Prior Art

Typical construction of a conventional printing type drum that contains hammers therein is known to be as illustrated in FIG. 1, FIG. 2 and FIG. 3 which is disclosed in U.S. patent application Ser. No. 155,157, filed May 30, 1980 now abandoned and refiled as continuation 407,296 on Aug. 11, 1982 and which is owned by the assignee of the present invention.

In the figures, the printing type drum, whose whole is designated by the reference numeral 1, is basically comprised of a cylindrically formed drum body 2. Grooves 2*a* are formed in the periphery of the drum body 2, spaced side by side in the axial direction of the drum body 2. These circular grooves 2*a* are demarcated by ridges 2*b*. Each of the grooves 2*a* has through holes 2*c* formed therein circumferentially in a queue at given intervals.

Printing type belts 3 are fitted in the grooves 2*a* of the drum body 2. Each printing type belt 3 is formed of an elastic material, such as NBR or urethane. On the surface thereof are provided raised type blocks 3*a* in a queue at a given spacing. Projection 3*b* are provided on the back of the printing type belt 3 in counter positions to the printing type blocks 3*a*. When the type belt 3 is fitted in the groove 2*a* of the said drum body 2, the projections 3*b* on the back of the type belt 3 are also fitted in the through holes 2*c* of the groove 2*a*, whereby the type belt 3 is secured to the drum body 2. In many cases, the type belt 3 is in a circular form with the ends thereof joined by a proper method.

A hammer unit 4 is accommodated in the drum body 2 installed with the type belts 3. The hammer unit 4 is basically constituted of a long and slender framework assembled with a pair of upper and lower support frames 5 joined at their ends 5*a*. Inside the support frames 5 are securely installed a plurality of hammer assemblies 6, spaced at given intervals, in the longitudinal direction of the support frames. As is clearly noted from the sectional view in FIG. 3, each of the hammer assemblies 6 has a yoke 7. The yoke 7 has a ⊐-shaped section and contains a coil 8 therein. A rod 9 is fitted in the center hole of the circularly formed coil 8 in such a manner that it is free to slide. The back end of the rod 9 is connected to one end of a guide rod 11 with the medium of a bracket 10. The guide rod 11 is fitted to the yoke 7 in parallel with the said rod 9 so as to slide freely, with a spring 12 provided between the outside of the yoke 7 and the bracket 10. And a hammer 13 is fixed to the forward end of the guide rod 11. The hammer 13 is constantly under the recoiling force of the spring 12 with the tendency to move away from the projections 3*b* on the back of the type belt 3.

As is clearly noted from FIG. 2, two hammers 13 are provided and protrude as a pair on the base 14 secured to the end of the guide rod 11, one each at the left and the right thereof. This provision is to allow two hammers to be operated with one hammer assembly. Corresponding with this, as shown in FIG. 1, the type belt 3 is attached one pitch behind or ahead of adjacent type belts so that the type blocks 3*a* adjacent to each other, and consequently the projections 3*b* adjacent to each other, are staggered. Of course, the through holes 2*c* formed in the grooves 2*a* of the drum body 2 are also staggered.

Now, in front of the printing type drum 1 having such a construction as has been described above, there is located a platen 15, and the printing paper 16 is allowed to run down through between the platen and paper guides 17 and 18 as it is printed, and is discharged by a drive roller 19 and a pinch roller 20.

An ink roller 21 is provided opposite to the platen 15, with the printing type drum 1 sandwiched, in such a position that it is always pressed against the type belt 3 under a given pressure.

In a printer equipped with the printing type drum having such a construction as has been described above, the printing type drum is rotated by means of a control unit not illustrated here. When the type block 3*a* of a selected type belt comes to a position facing the platen 15, the coil 8 is energized to produce a magnetic field. As a result, the rod 9 is moved toward the platen 15, overcoming the recoiling force of the spring 12, to cause the hammer 13 to strike the platen 15 via the typing paper 16, whereby the printing is accomplished. When the printing is finished, the hammer 13 is retracted by the recoiling force of the spring 12 and the type block 3*a* is returned to the original position by the elasticity that the type belt 3 itself possesses.

However, if such a construction of the printing type drum as has been described above is adopted, where an ink-moistened printing ink roller 21 is constantly pressed against the type belt, there arises a problem in that the ink is caused to invade the gap between the type belt 3 and the groove 2*a* of the drum body 5. This problem occurs by the capillarity developed because of the gap between the type belt 3 and the groove 2*a*.

The printing ink contained in the ink roller 21, being a liquid, is solidified when dried and produces an adhesion at the same time, resulting in the type belt 3 sticking to the groove 2*a* of the drum body 2.

In a printing type drum having built-in printing hammers, if such a phenomenon as has been described above occurs, a small amount of energy is no longer sufficient enough to continue printing while the type belt sticking to the groove is being removed, and a tremendous amount of energy is required to drive the hammers properly. Of necessity, therefore, a large hammer unit is required, and the printing type drum itself must be large in size, too. An energy too small for the hammering operation would result in a print with missing letters or incompletely typed letters.

BRIEF DESCRIPTION OF THE INVENTION

An objective of the present invention is to provide a printing type drum of such a construction that allows the entry of printing ink between the type belt and the drum body to be prevented. Another objective of the present invention is to reduce the energy required to drive the hammers. Still another objective is to make the type drum small in size and light in weight. Still another objective is to insure that other type does not contact the printing paper when a desired type is hammered to print.

DETAILED DESCRIPTION OF THE PREFERRED EMBODIMENT

Figure 1:
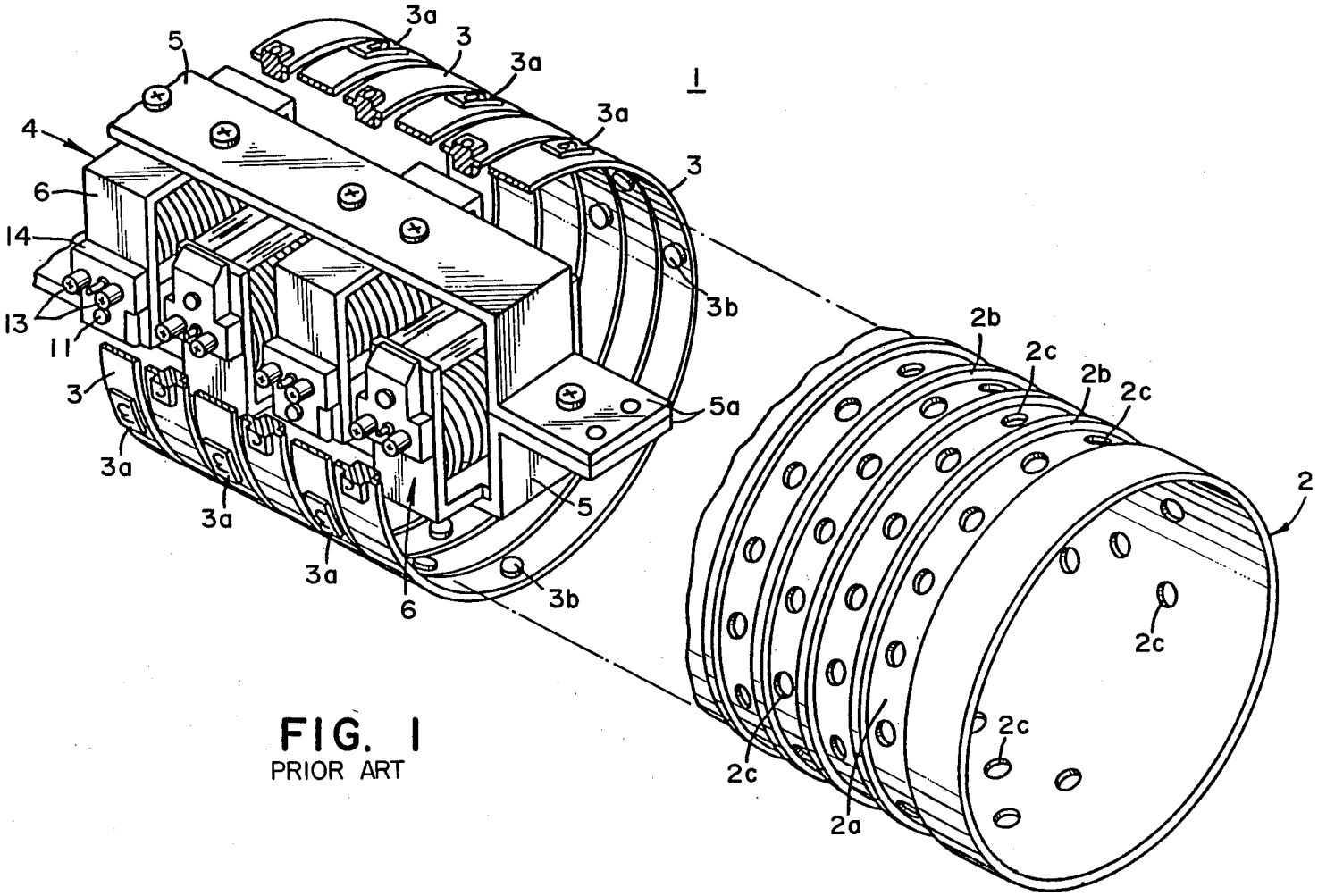
FIG. 1 PRIOR ART
FIG. 1, FIG. 2 and FIG. 3 are an exploded askew view, a back view and a vertical sectioned side view, respectively, all illustrating the construction of a printing type drum as disclosed in U.S. patent application Ser. No. 155,157.
Figure 2:
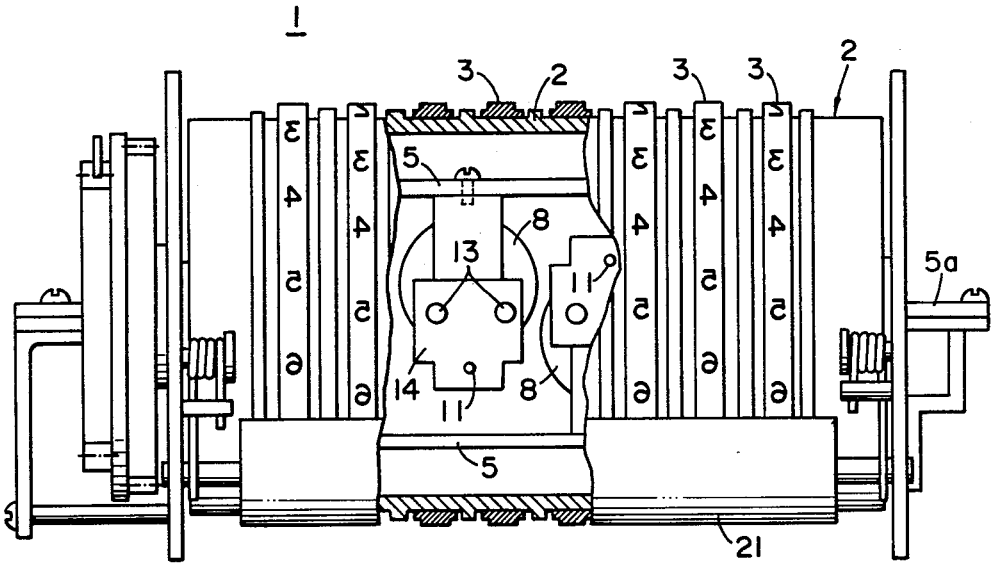
FIG. 2 PRIOR ART
Figure 3:
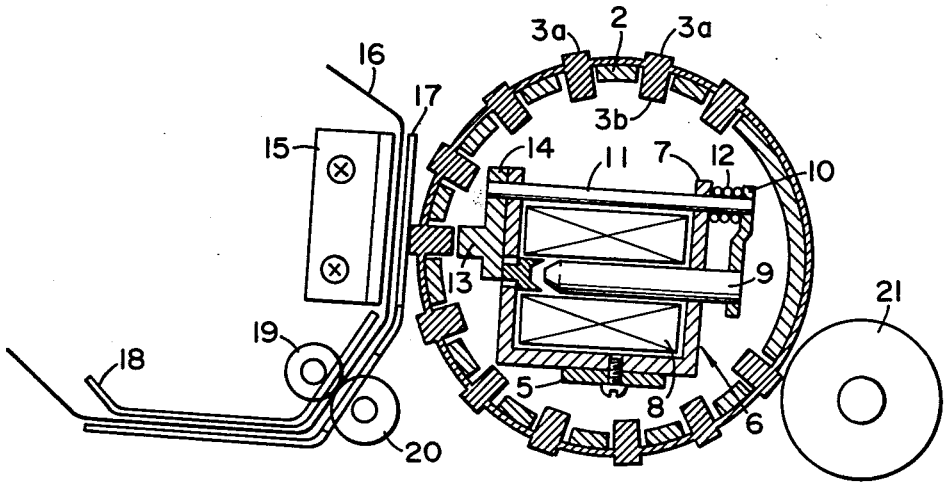
FIG. 3 PRIOR ART

One embodiment of the present invention will now be described in detail with reference to FIG. 4 and FIG. 5. In the figures, the reference numeral 30 designates the printing type belt. The printing type belt 30 is made of an elastic material, such as rubber, in a solid cylindrical form and installed round the drum body 2. The printing type belt 30 consists of an elastic sheet 31 that forms a basic body and type blocks 32. Lines of the type blocks 32 are formed solid with the sheet, spaced in the axial direction of the sheet 31 in a cylindrical form.

Figure 4:
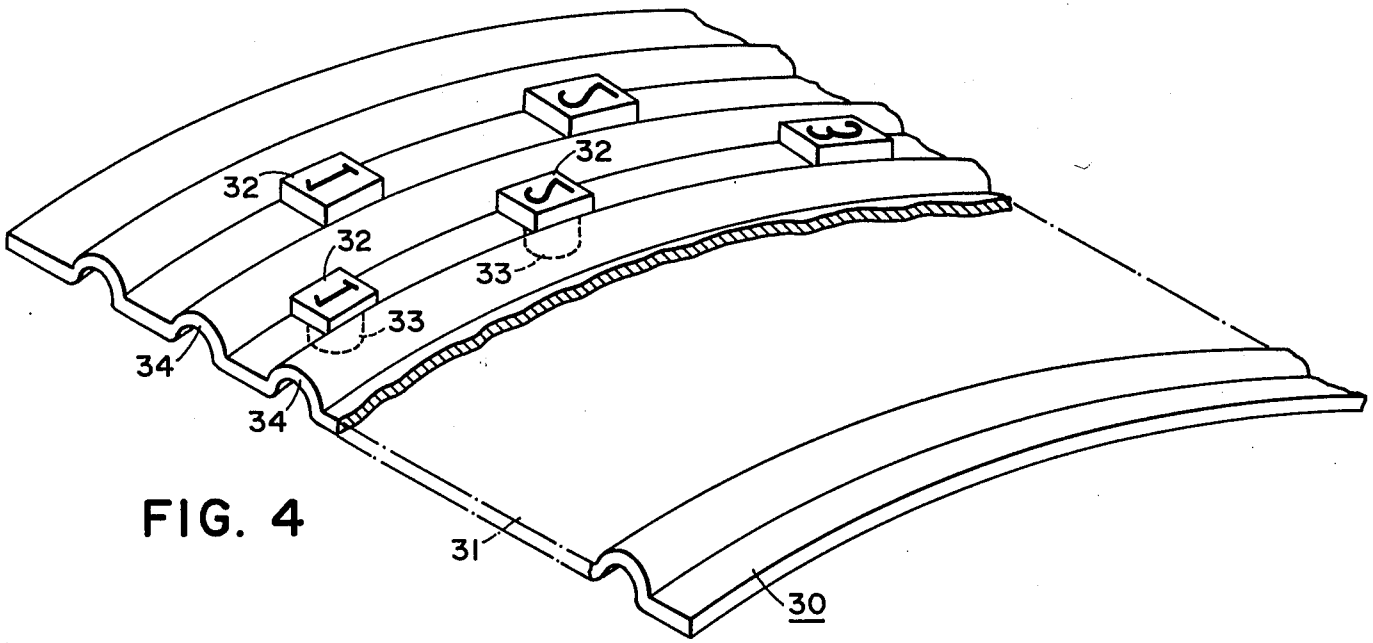
FIG. 4 and FIG. 5 are a magnified view of the printing type drum in part and a vertical sectioned side view thereof when fitted on the drum body, respectively both illustrating one embodiment of the present invention.

These lines of types, as shown in FIG. 4, are provided with the raised type blocks 32 spaced in a queue in the circumferential direction. On the back of the sheet 31 are formed projections 33 counter to the type blocks 32.

The type blocks adjoining each other in the axial direction are arranged in a staggered manner as shown in FIG. 4.

Now, film-coated ridges 34 that swell aside are formed on the sheet 31 over the entire circumference between the lines of the types, so that the line of the types is sandwiched between these film-coated ridges 34. The purpose of the provision of these ridges 34 is to prevent entry of printing ink between the drum body 2 and the type belt 30. Another purpose is to allow the printing to be accomplished in such a manner that the ridges 34 are elastically deformed when the projections 33 are striken with the hammers, whereby the printing is done with the type blocks 32 with a small amount of energy.

Figure 5:
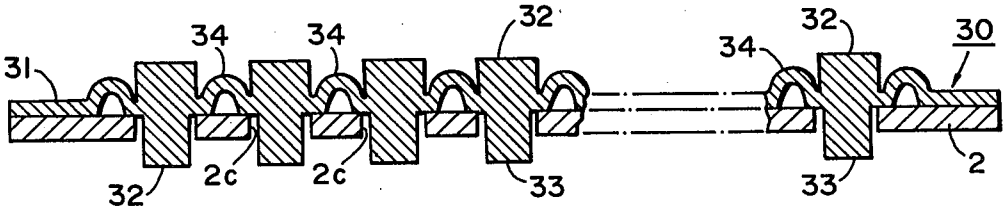

Of course, the projections 33 are fitted in the through holes 2c of the drum body 2 so that they are free to slide, as shown in FIG. 5.

Since this embodiment is such as has been described above in that the type belt is made of one solid sheet with film-covered ridges formed between the lines of types, the ink, which is press supplied constantly to the type blocks 32 on the type belt 30 by means of the ink roller, is not allowed to run in between the drum body 2 and the type belt, as witnessed in the conventional type drum, and no adhesion between the type belt 30 and the drum body 2 develops. This will eliminate the necessity of a tremendous impact energy to break the adhesion and allow the use of a smaller hammer unit. As the type belt 30 has the type blocks 32 sandwiched by the film-covered ridges 34 over the entire circumference, the impact applied to the type belt causes an elastic deformation to these ridges, allowing the type blocks 32 to be protruded toward the printing paper with a small amount of force. This will allow the use of a still smaller hammer unit with a smaller output. The type blocks 32 are staggered so that no type block is located in the same place of the adjoining line. Therefore, when a certain type block is hammered out toward the printing paper, there is no risk of any adjoining type block being hammered out toward the printing paper at the same time to smear the paper.

Figure 6:
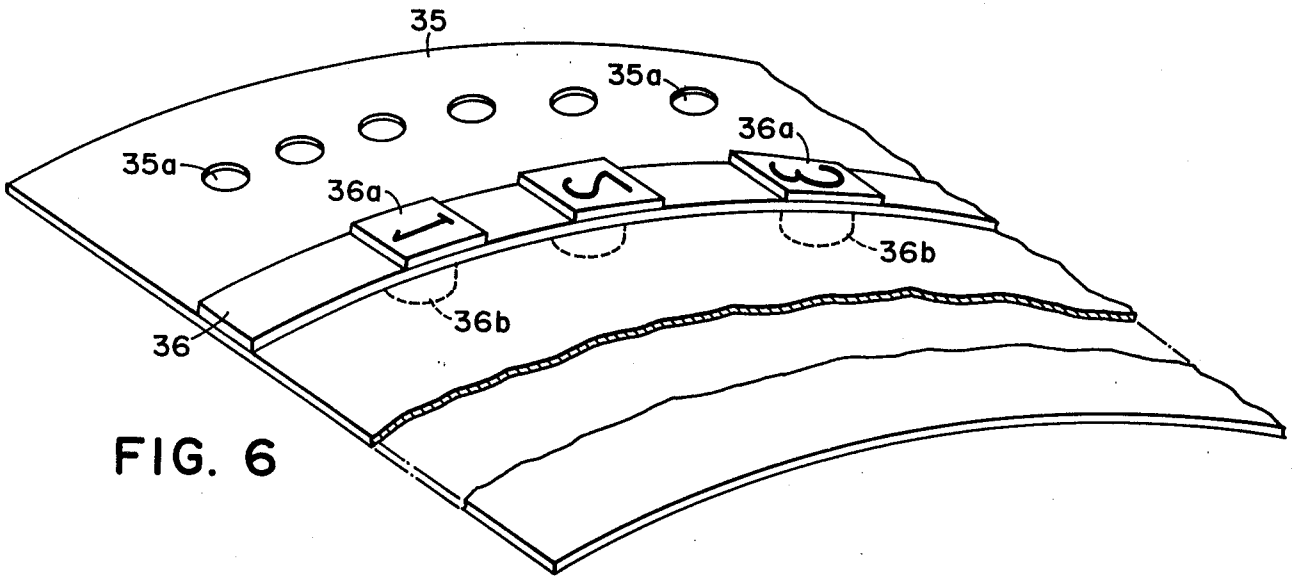
FIG. 6 and FIG. 7 are a magnified view of the printing type drum in part and a vertical sectioned side view thereof when fitted to the drum body, respectively both illustrating another embodiment of the present invention.
Figure 7:
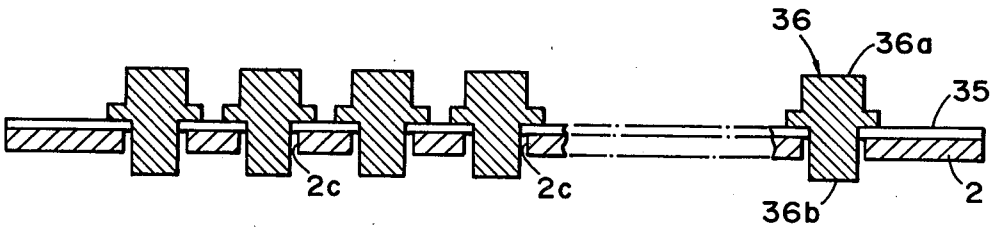

FIG. 6 and FIG. 7 illustrate another embodiment of the present invention, where the type belt has a very thin, highly elastic and elastically formed sheet 35, in which through holes 35a are formed in the counter position to the through holes 2c of the drum body 2.

Now, the reference numeral 36 designates an individual type belt formed almost the same as the conventional type belt. On the surface thereof are formed type blocks 36a in a queue, with projections 36b provided on the back. The projections 36b are press-fitted securely in the through holes 35a of the very thin elastic sheet 35 and are fitted in the through holes 2c of the drum body 2 in such a manner that they are free to slide. The individual type belts 36 are installed round the drum body 2 in such a way that they are one space ahead of or behind each other and consequently the type blocks are staggered, as shown in FIG. 4.

This embodiment being constituted such as has been described above, the type blocks 36a are caused to protrude by the hammers together with the very thin elastic sheet 35, and the very thin elastic sheet 35 is so elastic that it can be hammered out with a small amount of impact energy.

Like the aforementioned embodiment, the type belt in this embodiment is in a cylindrical solid form and of such a construction that the through holes 35a of the very thin elastic sheet 35 have the projections 36b of the individual type belt 36 press-fitted in, film-covered ridges are formed between the individual type belts and that ink will not flow in the direction of the drum body 2 through the through holes 35a without the risk of an adhesion being developed between the type belt 36 and the drum body 2. Also, as the type blocks are staggered, they will not smear the printing paper for the aforementioned reason.

Figure 8:
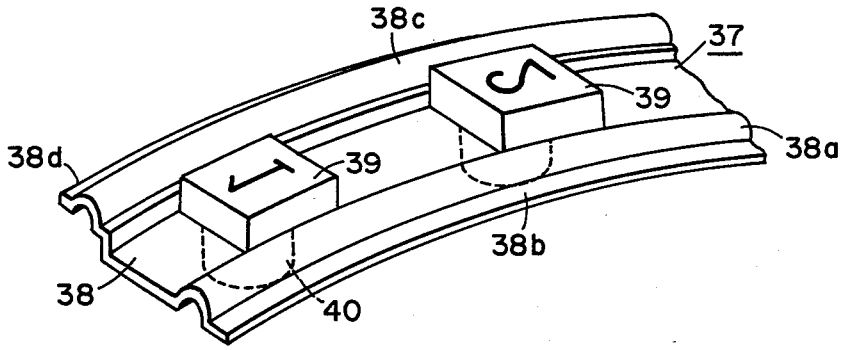
FIG. 8 and FIG. 9 are a magnified view of the printing type drum in part and a vertical sectioned side view thereof when fitted to the drum body, respectively both illustrating still another embodiment of the present invention.
Figure 9:
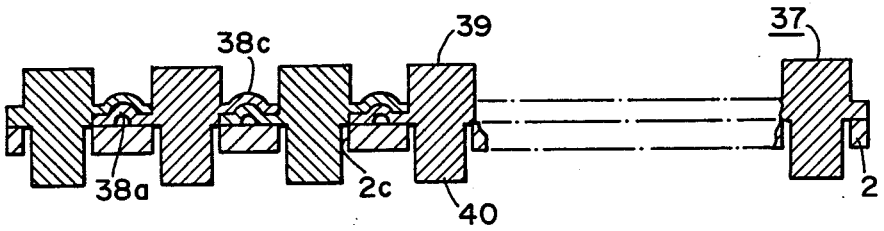

FIG. 8 and FIG. 9 illustrate still another embodiment of the present invention. In this embodiment, the type belts are not formed in a cylindrical solid form as in the case of the two embodiments earlier described, but as they are installed round the drum body with brims on both sides of one type belt placed over and under those of the adjoining type belts, they look as if they formed a solid cylinder. More particularly, as shown in FIG. 8 and FIG. 9, the type belt 37 is formed on a strip of the elastic sheet 38 with type blocks 39 arranged in a queue.

There is a low film-covered ridge 38a formed on one brim of the sheet 38, with a thin flat portion 38b left on the outer edge thereof.

A high film-covered ridge 38c is formed on the other brim of the sheet 38, with a thin flat portion 38d left on the outer edge thereof. Raised type blocks 39 are provided on the area sandwiched between the two film-covered ridges 38a and 38c, with projections 40 formed on the back of the sheet 38 in the counter position to the type blocks 39. The projections 40 are fitted in the through holes 2c of the drum body 2.

This embodiment being constructed such as above, when the type belts 37 are installed round the drum body 2 in the same number as the columns of the type drum, the lower film-covered ridges 38*a* of one type belt is overlapped by the higher film-covered ridge 38*c* of the adjoining type belt, with the side edges of the flat portions 38*b* and 38*d* placed in contact with the type blocks 39 of the respective type belts 37. The type belt is one space ahead or behind the adjoining type belts so that the type blocks thereof are staggered.

Thus, although the type belts 37 are independent of each other, the film-covered ridges formed to different heights on both brims thereof are overlapped, making the assembly of the type belts look as if it were a solid cylindrical formation. Besides, the overlapped film-covered ridge portions closely fit each other, thanks to the elasticity possessed by each ridge, so that ink is stopped by these lapped edges from flowing in toward the drum body 2, whereby an adhesion of the type belt to the drum body due to an invading ink will not occur.

As the adjoining type belts 37 are overlapped with the medium of the film-covered ridges 38*a* and 38*c* thereof, they are protruded almost independently of each other when struck by the hammers so that a small impact energy is enough to cause printing. This also permits the use of a smaller hammer unit. Also, the type blocks are staggered so that the printing paper will not be smeared by adjoining types.

What we claim is:

1. A printing type drum, comprising:

a cylindrical drum body having a circumferential surface with a plurality of through holes arranged in a plurality of circumferential lines along the surface; and an elastic type belt being formed of a plurality of thin strips, each strip having at least one ridge, with the ridges of adjacent strips placed over and under each other, said elastic type belt having a plurality of type blocks arranged on one side surface thereof and having a plurality of projections on the other side surface thereof, each projection corresponding to a separate one of said plurality of type blocks, said plurality of projections being positioned in said through holes when said plurality of strips is wound round said drum body.

2. A printing type drum according to claim 1, wherein adjacent strips are positioned so that their respective row of type blocks are in a staggered arrangement with respect to one another.

* * * * *